United States Patent [19]

Morner

[11] Patent Number: 4,991,503

[45] Date of Patent: Feb. 12, 1991

[54] HIGH PRESSURE INTAGLIO CANTILEVER PRESS

[75] Inventor: Robert W. Morner, Hamilton, Ohio

[73] Assignee: The Hamilton Tool Company

[21] Appl. No.: 398,134

[22] Filed: Aug. 24, 1989

[51] Int. Cl.[5] ..... B41M 1/10

[52] U.S. Cl. ..... 101/170; 101/153

[58] Field of Search ..... 101/153, 170, 483, 174, 101/216, 132, 136, 141; 100/168, 176

[56] References Cited

U.S. PATENT DOCUMENTS

| | | | |
|---|---|---|---|
| 573,407 | 12/1896 | Hale . | |
| 720,629 | 2/1903 | Sherwood . | |
| 1,599,868 | 9/1926 | Barton et al. . | |
| 3,161,125 | 12/1964 | Hornbostel . | |
| 3,344,643 | 10/1967 | Howard et al. . | |
| 3,369,383 | 3/1968 | Barnikel . | |
| 3,405,633 | 10/1968 | Price, Jr. et al. . | |
| 3,561,658 | 3/1971 | McDermott . | |
| 3,605,615 | 9/1971 | Huck | 101/153 |
| 3,894,488 | 7/1975 | Gazzola et al. . | |
| 4,188,874 | 3/1980 | Heuss . | |
| 4,372,205 | 2/1983 | Pflaum . | |
| 4,438,695 | 3/1984 | Maier et al. . | |
| 4,487,122 | 12/1984 | George et al. . | |

FOREIGN PATENT DOCUMENTS

| | | |
|---|---|---|
| 687191 | 1/1940 | Fed. Rep. of Germany . |
| 2849202 | 6/1980 | Fed. Rep. of Germany . |

*Primary Examiner*—Eugene H. Eickholt

*Attorney, Agent, or Firm*—Wood, Herron & Evans

[57] ABSTRACT

An intaglio printing press is disclosed employing cantilevered press rollers which can be easily removed and replaced, and which are supported to apply high uniform printing pressure to a substrate web. The rollers are each mounted on a spherical bearing permitting them to cant such that their axes remain parallel. One roller shaft is fixed to a frame and the other is carried by deflectable slides carried by the frame. The high printing pressure is achieved by shifting one shaft by driving the slides with hydraulic rams against adjustable stops formed by movable wedges.

15 Claims, 4 Drawing Sheets

HIGH PRESSURE INTAGLIO CANTILEVER PRESS

FIELD OF THE INVENTION

The present invention relates to the art of printing and more particularly to the support of interchangeable printing cylinders on intaglio printing presses used in high pressure printing processes.

BACKGROUND OF THE INVENTION

Intaglio printing is a process by which a printed image is formed upon paper or other printing substrate material by passing the material, frequently in web form, between a pair of press rolls. In the process, the rolls are thrust together under high pressure to compress the substrate therebetween to transfer ink from an inked image on an engraved or etched plate cylinder or sleeve carried by one of the rolls to the substrate surface. High pressure processes of this type include rotogravure printing processes in which a high resolution plate is made to carry an inked image in recesses engraved into the plate surface from which the ink to be pressed from the grooves when the plate is brought into high pressure contact with the paper. The use of the extreme pressure facilitates the transfer of ultra high resolution line images to the paper. Such processes are useful in printing money and other certificates where the printing must be of extremely high quality.

Intaglio presses employ a pair of rollers or printing cylinders, including a plate cylinder which carries the image to be transformed to a paper substrate, and an impression cylinder which underlies substrate and forms a supporting surface against which the plate cylinder presses the paper during printing. In the printing process, high pressure is exerted upon the paper by the pair of cylinders compressing it from opposite sides.

In fine quality, high resolution intaglio printing processes such as those employed for the printing of currency, bank notes and the like, these pressures may be exceptionally high, even up to 10,000 pounds per linear inch across the width of the print rolls. The maintenance of a uniform high pressure across the width of the rolls is important to the production of high resolution, high quality printed images. This requires that the roller supporting structure be such that the contact between the impression and plate cylinders be maintained uniformly across the width of the rollers as they contact the substrate.

The response of the prior art to the need to provide high uniform pressure across the width of print rolls has been to apply, and control the application of, force at least at both ends of the printing cylinders or press rolls, and often to exert force on the rollers at multiple points across the width of the printing surface. The direction of the prior art has been to subject the rollers to a distributed or multipoint force, acting upon the rollers, which produces a certain amount of undesirable roll deformation, and to further distribute or modify the force to correct for the deformation of the rolls. Such deformation, if produced and uncorrected, results in the unwanted non-uniformity of printing pressure across the width of the rolls. The structures employed to correct the deformation have been complex and less then totally effective.

Another problem with prior art intaglio presses has been the time required to service the printing rolls. These rolls must be removed for periodic maintenance and to permit replacement of the impression sleeve carried by the impression cylinder. The sleeves are subject to heavy wear and in some installations must be replaced as often as every two days. Prior art roll constructions have required an excessive amount of time to change rolls. For example, in a typical press, a half a day is required.

For small article low pressure printing and embossing processes, printing presses have been provided with a printing roller rotatably mounted to a shaft which are supported to a frame at one end. Such presses for example are shown in Hale U.S. Pat. No. 573,407, Sherwood U.S. Pat. No. 720,629, Barton et al U.S. Pat. No. 1,599,868, Price, Jr. et al U.S. Pat. No. 3,405,633, Heuss U.S. Pat. No. 4,188,874, and German U.S. Pat. No. 687,191. Such methods of supporting rollers in a printing press upon a cantilevered shaft provides for easier means interchanging of the plate cylinders than where rollers are mounted to shafts supported at both ends. However, the mounting of cylinders in cantilevered fashion has never been successful to support rolls for high pressure engagement as is required for intaglio printing.

One proposed intaglio press construction using cantilevered rolls is disclosed in Heuss U.S. Pat. No. 4,188,874. In the press disclosed in that patent, one or both of the press rolls are cantilevered. However, no means is provided for applying forces to the roller shafts to shift the shafts relative to one another to create a high printing pressure. Rather, a special roll referred to as a pressure equalization roll is employed as one of the rollers. The pressure equalization roller uses internal hydraulically actuated supporting elements in order to distribute the pressure across the width of the roller to compensate for roller distortion. This construction is not a practical approach to providing a high pressure intaglio press with a uniform pressure across the rollers.

Prior art press construction has also employed a variety of roll mounting devices used in such a way as to affect the roll positions. Several printing presses, for example, have employed pressure roller sleeves supported by a multiplicity of bearings disposed adjacent to the longitudinal axis of the roller to support the cylinders on the shafts. Such presses are shown in Hornbostel U.S. Pat. No. 3,161,125, McDermott U.S. Pat. No. 3,561,658, Pflaum U.S. Pat. No. 4,372,205, Maier U.S. Pat. No. 4,438,695, George et al U.S. Pat. No. 4,487,122, and German Offenlegungsschrift No. 2,849,202. In the presses described in such patents, however, any uniformity of pressure between the mating rollers is achieved by using roller supporting shafts mounted at both ends to a frame.

Notwithstanding the state of the printing art, the high pressure presses which have been developed to date have failed to provide for rapid and easy interchange of printing rolls and plates. The problems of providing uniform high pressure contact between the plate and the paper have resulted in conditions which have aggravated the problem of roll interchangeability. Accordingly, there exists a need for providing a cylinder support for intaglio presses which will provide a uniform high pressure across the rolls and which will provide rapid removal and replacement of the rolls.

SUMMARY OF THE INVENTION

It is a primary objective of the present invention to provide an intaglio printing press which is capable of performing high pressure printing processes where the high pressure is applied to the print substrate between a pair of printing rolls with a uniform distribution across the width of the roll surface. It is a further objective of the present invention to provide such an intaglio press in which the rolls are easily accessible and can be removed and replaced with ease in a relatively short time. It is an additional objective of the present invention to provide an intaglio printing press which will economically and efficiently produce high quality high resolution printed documents such as currency, bank notes, and the like.

According to principles of the present invention, there is provided an intaglio printing press having a pair of cylinders or rollers rotatably mounted to a pair of approximately parallel shafts which are supported to a rigid frame at only one side of the rollers. The rollers are mounted to the free ends of the shafts in cantilevered fashion for easy exchangeability. The high pressure contact between the rollers is achieved by forces exerted on one shaft at the frame entirely to one side of the rollers. These forces displace the shaft angularly with respect to the stationary shaft. The rollers are supported to the shafts in such a way as to allow them to tilt to accommodate any change in the relative angulation of the shafts and thereby maintain a uniform contact pressure between the rollers across their widths.

In a preferred embodiment of the present invention, the forces between the opposed rollers are exerted in part by providing hydraulic rams or cylinders which displace two movable slides. These slides carry the journals in which the shaft of one of the rollers of the pair is mounted. The hydraulic cylinders displace the movable shaft with respect to the fixed shaft on which the other roller is mounted and which is rigidly mounted to the press frame.

More particularly, in the preferred embodiment of the invention, the shaft carrying the upper roller, is supported between front and back slides which are carried by a fixed frame. The frame also supports the lower shaft upon which the lower roller is mounted. The slides are interconnected to the hydraulic cylinders which operate to shift the upper shaft with respect to the lower shaft to apply squeezing pressure between the rollers.

Also in the preferred embodiment, the rollers are supported on their respective shafts so that they can undergo limited pivotal movement relative to their mounting shaft. More particularly, the rollers are mounted on spherical bearings interposed between the shafts and the rollers to permit the rollers to not only rotate on the shafts but to pivot to accommodate for any non-parallel orientation of the shafts. The spherical bearings are preferably disposed on the shaft adjacent to the axial center of the assembled rollers.

Further according to the preferred embodiment of the present invention, wedges are provided between the slide and the frame in the front and rear yokes to control the tilting of at least one of the shafts so as to adjust the pressure distribution between the mating rolls.

In addition, in the preferred embodiment of the present invention, the printing rollers are sufficiently narrow with respect to their diameters, and sufficiently rigid, to resist local deformation of portions of the rollers, and are mounted so as to move with respect to each other to self align under the influence of the forces provided by their supports. The two rollers are forced together under relatively high pressures of, for example, up to 10,000 pounds per linear inch. This pressure is uniform across the entire width of the rolls.

The principal advantage of the present invention is that the rolls so supported are more accessible and can be replaced in as little as fifteen minutes. This is a small fraction of the time in which the rollers of high pressure intaglio presses could be replaced in the prior art. Further advantages of the present invention are that high pressure printing is achieved with pressures distributed uniformly across the rollers so that high quality high resolution printing is accomplished. Furthermore, the printing process can be carried out at high speed on a narrow continuous web requiring only limited cutting to separate the finished product. The invention is particularly advantageous for production of bank notes, currency, and such high resolution items in multiple denominations and large quantities.

The advantages of the present invention are in part achieved by providing a mounting structure on one side of the rollers, including front and back yokes, both of which are massive. The lower drive shaft which extends horizontally outwardly from bearings carried by the pair of yokes. The upper drive shaft extends outwardly from bearings carried by slides which are slidably mounted to the yokes. These rollers bearings are subjected to pressures exerted by hydraulic cylinders which shift the free end of the upper shaft to press the upper roller against the lower roller. Spherical bearings on which the rollers are mounted to the shafts allow the rollers to shift to accommodate for any non-parallelism of the shafts. This freedom of the roller axes to cant a limited degree ensures uniform contact between the sleeves of the rollers across their width irrespective of nonparallelism of the shafts. In addition, the cylinders are proportioned so as to accommodate relatively large diameter shafts in relation to the extended width of the printing cylinders. This, coupled with the rigid construction of the cylinders on which the printing sleeves are mounted prevents distortion of the printing surfaces and allows the shaft canting ability to more fully adjust the pressure uniformly across the printing width of the rollers. In addition, the relative inclination of the shafts with respect to each other may be controlled by wedges which can be shifted in and out under manual control to limit the printing squeeze between the cylinders of the pair. This positioning of the wedges limits the deflection of the shafts by the hydraulic cylinders and provides ultimate limiting control of the printing pressure and relative shaft orientation.

These and other objectives and advantages of the present invention will be more readily apparent from the following detailed description of the drawings in which:

DETAILED DESCRIPTION OF THE DRAWINGS

Figure 1:
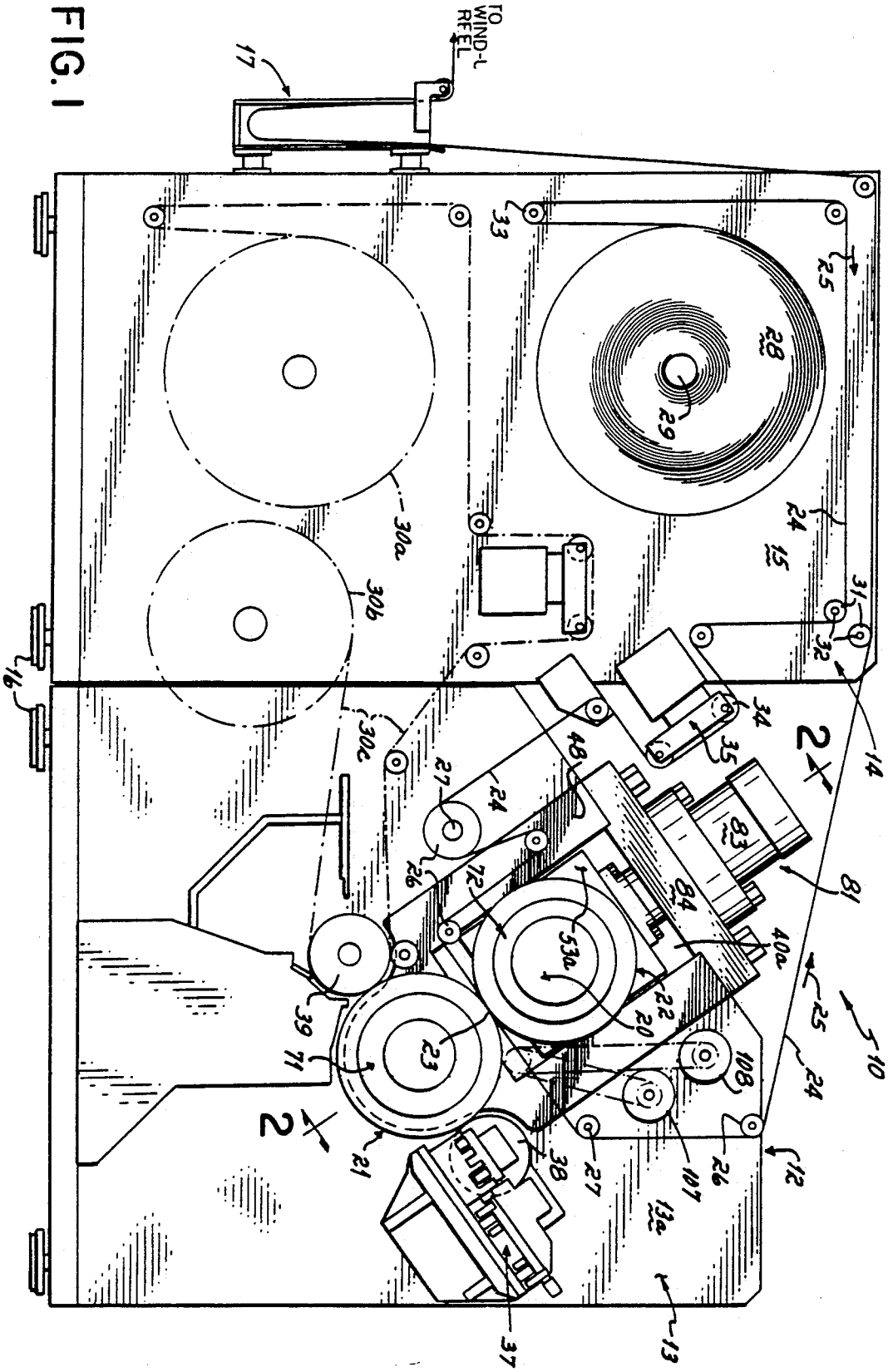
FIG. 1 is a side elevational view of a preferred embodiment of an intaglio printing press embodying principles of the present invention.

An intaglio printing press 10 constructed in accordance with the present invention is illustrated in FIG. 1. The press 10 is particularly suited to the performance of a high pressure intaglio printing process for the printing of fine, high quality, high resolution images for currency and the like. The press 10 includes a printing section 12 having a rigid stationary frame 13, only the front portion 13*a* of which is visible in FIG. 1, and a spool support section 14 having a rigid stationary frame 15 rigidly connected to the frame portion 13. Both of the frame sections 13 and 15 are supported on a plurality of adjustable feet 16. A vacuum operated drying loop 17 is mounted to the end of the frame 15 of the spool support section 14 to receive the printed web for drying. From the dryer 17, the web proceeds downstream to a wind up reel section (not shown).

The printing section 12 of the press 10 includes the print station 20 which includes a plate cylinder roller assembly 21 and an impression cylinder roller assembly 22 between which passes, at the juncture or printing nip 23 of the rollers 21 and 22, a continuous web 24 of print substrate or printing paper. The web 24, during the printing process, continuously moves downstream in the direction of the arrow 25 around a series of idler rollers 26 each rotatably mounted on one of a plurality of cantilevered shafts 27 each extending from the front side of the front portion 13*a* of the frame 13 of the print section 12. The continuous web of printing paper 24 is supplied from a supply spool 28 rotatably mounted on a cantilevered shaft 29 extending from the front side of the front portion of frame 15 of the spool section 14 of the press 10. The spool section 14 also carries a supply spool 30*a* and a take-up spool 30*b* for supplying and taking up a continuous web 30*c* of wiping paper similarly supported on transverse shafts on the frame 15. The spool section 14 also includes a plurality of guide rollers 31 rotatably mounted on cantilevered shafts 32 projecting also from the front of the frame section 15 of the roller section 14 for guiding the print paper web 24 and the wipe paper 30*c*. The shafts 27, 29 and 32 are all generally horizontal and oriented transverse the machine 10 and generally parallel to each other. Web tension is maintained by a dancer roller 33 and the rollers 34 of a web guide and tensioning device 35. The rollers 33, 34 are supported on horizontal transverse shafts which are movable transverse to the path of the web 24 for controlling the tension of the moving web.

The print station 12 is provided with an ink mill assembly 37 having an inking roller 38 positioned to make rolling contact with the plate roller 21 to transfer ink thereto. A wiper roller 39 applies the wiping paper web 30*a* against the plate cylinder roller 21, moving it in the opposite direction as that of the surface of the plate roller 21, making wiping contact therewith.

Figure 2:
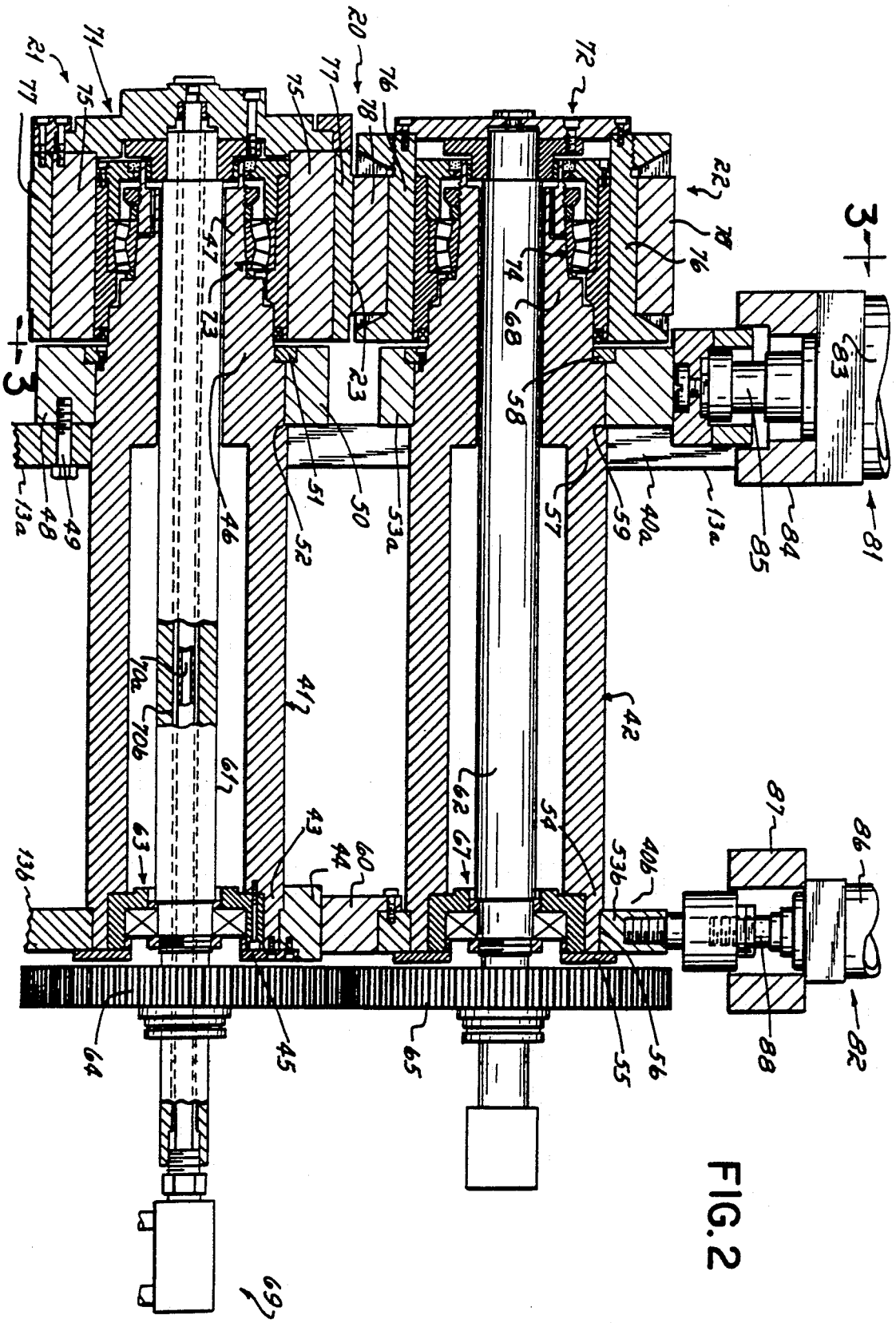
FIG. 2 is a cross-sectional view through the press roll cylinders of the preferred embodiment of the press along line 2—2 of FIG. 1.

Referring to FIG. 2, a cross section through the print station 20 illustrates the front portion or front housing 13*a* of the frame 13 and the back portion or back housing 13*b* of the frame 13. The housings 13*a*, 13*b* are part of the rigid fixed frame 13 of the printer section 12.

Figure 3:
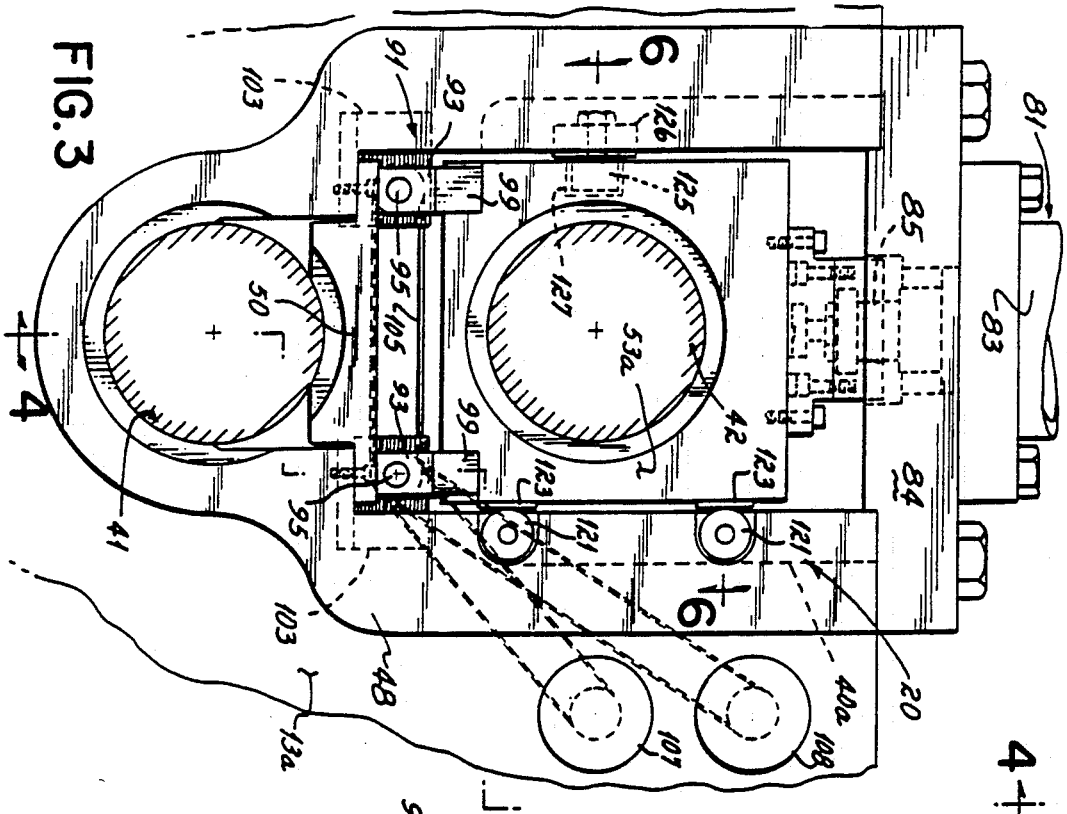
FIG. 3 is a cross-sectional view perpendicular to the axes of the cylinders of the press along line 3—3 of FIG. 2 (viewed in the same direction as FIG. 1).
Figure 4:
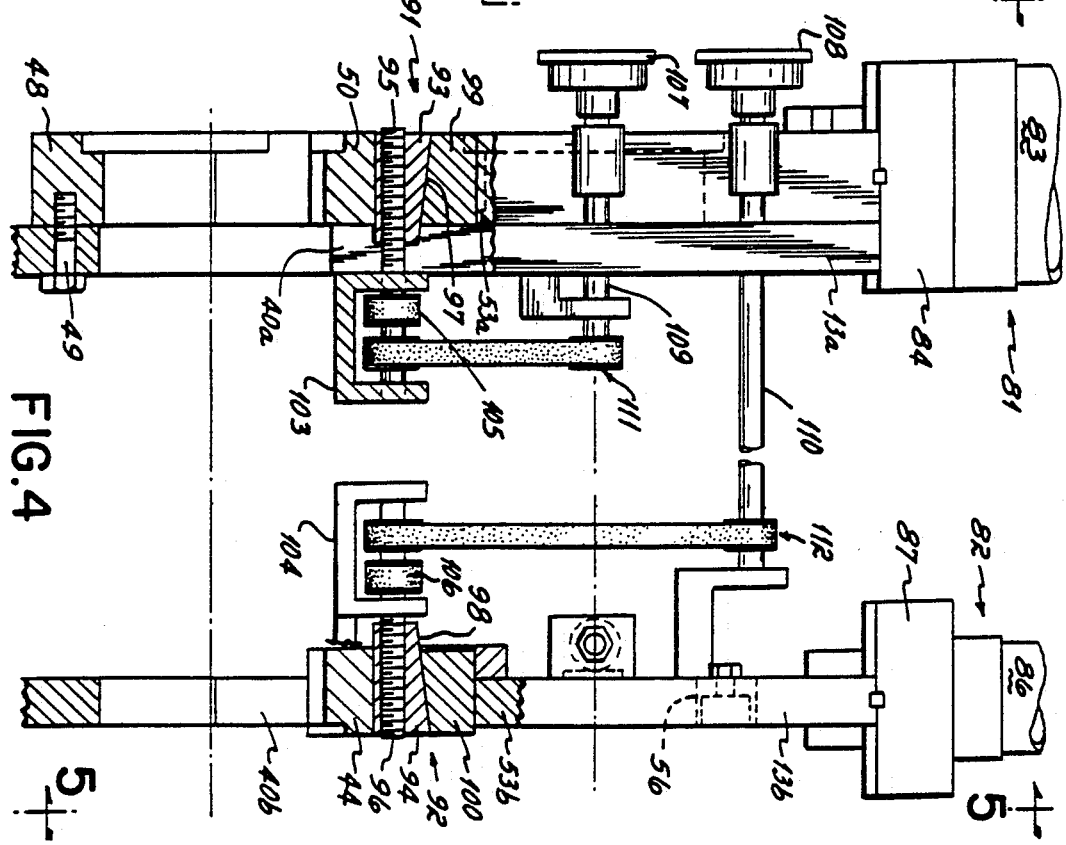
FIG. 4 is a view, partially in cross-section and partially broken away as seen generally along line 4—4 of FIG. 3.
Figure 5:
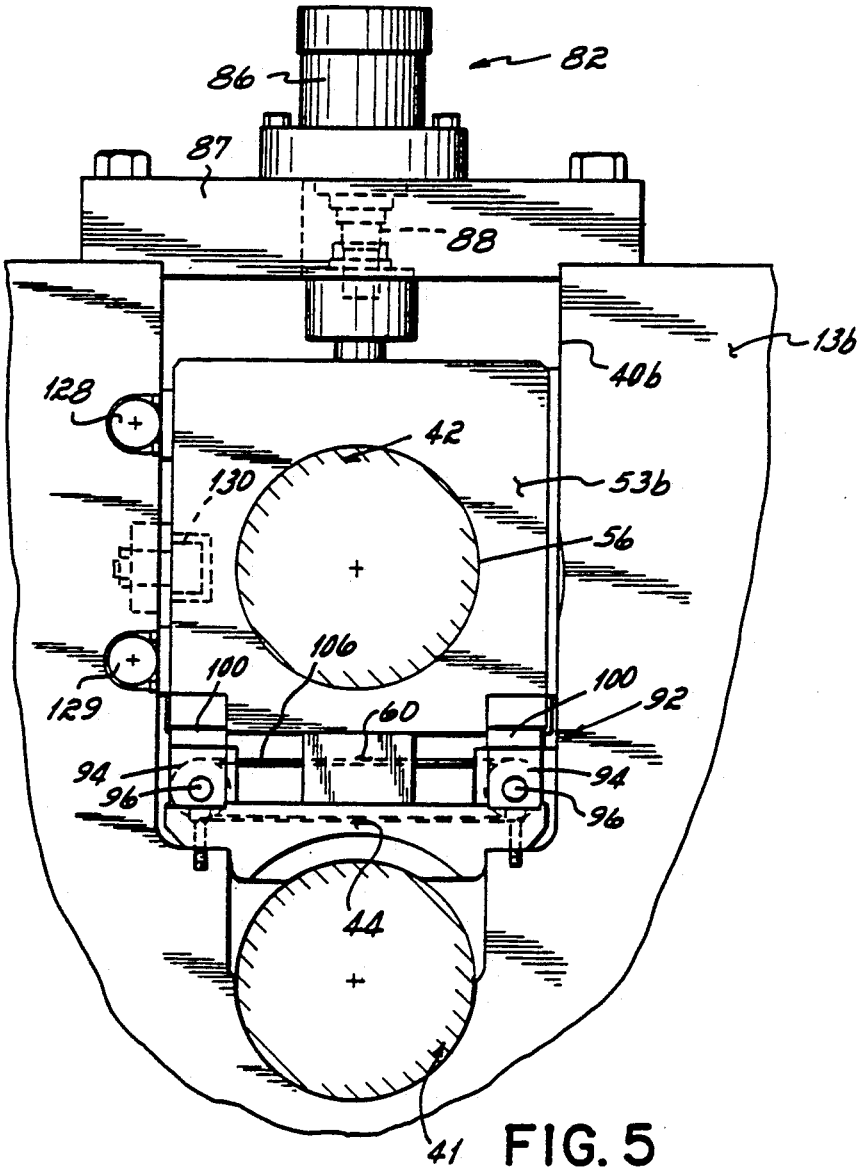
FIG. 5 is a view along line 5—5 of FIG. 4.

The frame 13 has formed therein front and rear recesses or shaft support yokes 40*a* formed in the front housing 13*a* and 40*b* formed in the rear housing 13*b* (see FIGS. 3, 4 and 5). Extending horizontally transversely of the front and rear frame housings 13*a*, 13*b* of the press 10 is a lower rigid hollow cylindrical plate support shaft 41 and an upper rigid hollow cylindrical impression support shaft 42. The shaft 41 is rigidly secured at its back end 43 to the back housing 13*b* in a rear yoke 40*b* of the rear housing 13*b* by rear clamp 44 and a cover plate or retainer ring 45 bolted to the back housing 13*b* at the lower end of the rear recess or yoke 40*b*. The lower shaft 41 has a front section 46 rigidly secured through the lower end of the front yoke 40*a* in the front housing 13*a*. An insert housing or collar 48 is rigidly secured by bolts 49 to the front housing 13*a*. A front clamp 50 is bolted to the collar 48 to firmly clamp the forward section 46 of the shaft 41 in the front yoke 40*a* of the front housing 13*a*. A forward keeper ring 51 is secured to the forward portion 46 of the shaft 41 to retain the shaft against transverse movement on the machine by clamping the collar 48 and clamp 50 between the ring 51 and a shoulder 52 formed at the forward portion 46 of the shaft 41. So supported, the lower shaft 41 has its extreme forward end 47 supported in cantilevered fashion extending forward of the front frame member 13*a*. This forward end portion 47 carries roller 21 as is explained in detail below.

The upper shaft 42 is adjustably mounted in the frame 13 and extends horizontally above and approximately parallel to the lower shaft 41. The upper shaft 42 is supported on the frame 13 at the back housing 13*b* and at the front housing 13*a* so as to be verticallY movable therein with respect to the frame 13. By "vertically movable" it is meant that the mounting points of the upper shaft 42 in the yokes 40*a* and 40*b* of the housings 13*a* and 13*b*, respectively, are capable of sufficient movement to influence the pressure between the plate and impression press rolls 21 and 22 as explained elsewhere herein. This movement may be only a small deflection of the position of the shaft 42.

The adjustable mounting of the upper shaft 42 is provided by a pair of front and rear shaft guides or slides 53*a* and 53*b*, each slidably mounted with respect to the front and back housings 13*a*, 13*b*, respectively. The upper shaft 42 is rigidly attached to the back housing slide 53*b* at its rear end 54 (FIG. 2) by a cover plate or retainer ring 55 which secures the back end 54 of the shaft 42 at a hole 56 in the rear slide 53*b*. The forward portion 57 of the shaft 42 is rigidly secured to the front slide 53*a* by a keeper ring 58 attached to the shaft 42 to clamp the slide 53*a* between the ring 58 and a shoulder 59 formed in the shaft 42. A stop block or spacer 60 is bolted to the lower side of the rear slide or guide 53*b* to limit the lower position of the rear slide 53*b* in the rear yoke 40*b* by resting against the rear clamp 44.

Extending through the hollow cylindrical shafts 41 and 42 are a pair of rotary drive shafts 61 and 62, respectively. These drive shafts rotate within and with respect to the hollow shafts. To this end, the lower drive shaft 61 is rotatably supported at the back end 43 of the shaft 41 by a bearing assembly 63 mounted between the shaft 41 and the shaft 61. Shaft 61 extends beyond the shaft 41 and through the lower portion of recess or yoke 40*b* where it has mounted to its rear end behind the back housing 13*b* a drive gear 64. The drive gear 64 is drivably connected to an identical driven gear 65 similarly rigidly mounted to the back end of the upper drive shaft 62 at its extent through the hollow shaft 42 and the rear housing 13*b*. This shaft 62 is likewise supported by bearing assembly 67 to rotate within shaft 42.

As with the lower shaft 41, the upper shaft 42 has its extreme forward end 68 cantilevered forward of the front frame 13*a* extending approximately parallel to the extreme forward end 47 of the lower shaft 41. The forward end 68 carries upper cylinder 22. The lower shaft 41 is provided with cooling or heating means 69 communicating with fluid input and return ducts 70*a*, 70*b* in the shaft 41 for communicating fluid to maintain the temperature of the plate cylinder and the ink thereon. Additional passageways (not shown) are provided in the plate roller assembly 21 to maintain the desired temperature.

The front ends 47 and 68 of the respective lower and upper shafts 41 and 42 extend through the insert housing or collar 48 and upper guide or slide 53*a* respectively to provide cantilevered support to the respective printing roller assemblies 21 and 22. Extending through these forward ends 47 and 68 of the shafts 41 and 42 are the respective forward ends of the drive shafts 61 and 62. The lower roller assembly 21 is rigidly connected to the forward end of the shaft 61 by a cap or hub assembly 71 while the upper impression roller assembly 22 is rigidly connected to the forward end of the upper shaft 62 by a cap or hub assembly 72. Between the projecting front ends 47 and 68 of the respective shafts 41 and 42, and the respective printing roller assemblies 21 and 22, are spherical bearings 73 and 74, which mount the respective plate and impression sleeves 75 and 76 to the free ends 47 and 68 of the shafts 41 and 42. The bearings 73 and 74 are respectively mounted on the shafts 41 and 42 at the axial midpoints of the roller assemblies 21 and 22 respectively.

The lower print roller or roller assembly 21 includes a plate sleeve 75 which surrounds the projecting front end 47 of the shaft 41. Sleeve 75 is mounted on the outer race of the bearing 73 so as to rotate about the fixed shaft 41. The sleeve 75 is secured at its front end to the lower cap or hub assembly 71 so as to rotate with the hub 71 as it is driven by the rotation of the drive shaft 61, which flexes slightly so as to permit slight tilting movement of the axis of sleeve 75 with respect to shaft 41. Similarly, an upper impression sleeve 76 surrounds the front end 68 of the shaft 42 and is rigidly secured at its inner surface to the outer race of the upper bearing 74. The front end of the sleeve 76 is similarly secured to the upper cap or hub assembly 72 so as to rotate on the bearing 74 with the hub 72 as it is driven by the shaft 62 and so as to permit slight tilting movement of the axis of the sleeve 76 thereon.

Surrounding the outer surface of the plate sleeve 75 of the lower print roller assembly 21 is the plate cylinder 77, the outer surface of which carries the image which is transferred to the paper web 24 as it is compressed between the plate cylinder 77 and an impression cylinder 78 which is similarly mounted around the impression sleeve 76 of the upper print roller assembly 22. These cylinders 77, 78 are positioned on the axial centers of the bearings 73 and 74 so that, when the pressure is uniformly distributed across their widths against the web 24, the roller assemblies 21 and 22 are balanced and will not change tilt on the shaft ends 47 and 68.

The pressure for compressing the web 24 between the plate cylinder 77 and the impression cylinder 78 of the roller assemblies 21 and 22 respectively are exerted by a pair of hydraulic ram assemblies 81 and 82. The front ram assembly 81 includes a cylinder housing 83 rigidly supported upon a cylinder support 84 which bridges the mouth of yoke recess 40*a*of the front housing 13*a* of the frame 13. A movable piston rod 85 of the ram assembly 81 has its lower end rigidly secured to the forward shaft guide or slide 53*a*. Similarly, the back ram assembly 82 includes a cylinder 86 secured to a cylinder support 87 which bridges the yoke or recess 40*b* of the back housing 13*b*. A movable piston rod 88 is secured to the back shaft guide or slide 53*b*.

The ram assemblies 81 and 82 operate to exert downward pressure upon the front and back guides or slides 53*a* and 53*b*, respectively, to thrust the impression cylinder 78 of the upper impression roller assembly 22 against the printing plate cylinder 77 of the lower plate roller assembly 21 so as to squeeze the web 24 between the cylinders 77 and 78 to exert high printing pressure thereupon.

The width of the web 24 and the cylinders 77 and 78 are generally less than the diameter of the roller assemblies 21 and 22 and, accordingly, retain rigidity across their widths as they are driven together at high pressure under the influence of the hydraulic cylinders 81 and 82. Preferably, the web 24 is as wide as a single document so as to minimize cutting and require only transverse cutting to separate printed documents from the web 24, and to minimize distortion of the print sleeves 77 and 78. In the printing of currency, for example, the width of the web 24 is preferably the long dimension of the individual bills.

The control of the pressure is facilitated by the mounting of the shaft 42 which supports the upper roller 22 in the guides or slides 53*a* and 53*b* upon the housing 13. As this pressure is being exerted, any nonparallelism between the shafts 41 and 42 is automatically compensated for by the spherical bearings 73 and 74 centrally positioned on the axes of the assemblies 21 and 22, respectively so as to allow the roller assemblies 21 and 22 to tilt and level with respect to each other so as to maintain a relatively parallel orientation.

The leveling of the shafts 41 and 42 is in part maintained by front and back stop assemblies 91 and 92 as shown in FIG. 4, with the front stop assembly 91 being also illustrated in FIG. 3 and the back stop assembly 92 being also illustrated in FIG. 5. Referring to these figures, the assemblies 91 and 92 include front and back pairs 93 and 94 which are mounted so as to move axially transverse the machine 10 along respective front and rear pairs of drive screws 95 and 96 to move the upper inclined surfaces 97 and 98, respectively, of the wedge pairs 93 and 94 to raise and lower respective camming block pairs 99 and 100, each respectively rigidly secured to the bases of the vertically movable guides or slides 53*a* and 53*b*.

The front and rear wedge drive screws 95 and 96 are rotatably mounted in front and rear brackets 103, 104 respectively secured to the front and rear housings 13*a* and 13*b*. The screws of each of the screw pairs 95 and 96 are linked so as to move together in synchronism by front and rear belts 105 and 106 respectively. The front and rear screw pairs 95 and 96 are manually operable by front and rear pressure control knobs 107 and 108 rotatably supported on the front housing 13*a* on transverse shafts 109 and 110 each respectively linked through a pulley and belt assembly 111 and 112, respectively, to the screw pairs 95 and 96, respectively. The rear shaft 110 is also supported by the rear frame 13*b*. The movement of the wedge pairs 93 and 94 raises and lowers the block pairs 99 and 100 to limit the respective lower position of the shaft guides or slides 53*a* and 53*b* with respect to the lower shaft 41. As such, the extreme position of the slides is controlled so as to regulate the relative tilt of the shafts 41 and 42 with respect to each other and thus to limit the adjustability of the parallel relationship between the upper and lower shafts 42 and 41, respectively. Hydraulic rams 81 and 82 drive the slides 53*a*, 53*b* against the lower limit set by the wedge pairs 93 and 94 to cause a deflection of the shafts 41 and 42 at the planes of the recesses or yokes 40*a* and 40*b*. As a result of this deflection, the contacting cylinders 77 and 78 are driven together at precise controlled pressure by bending moments along the cantilevered ends 47 and 68 of the shafts 41 and 42 to the spherical bearings 73 and 74.

Figure 6:
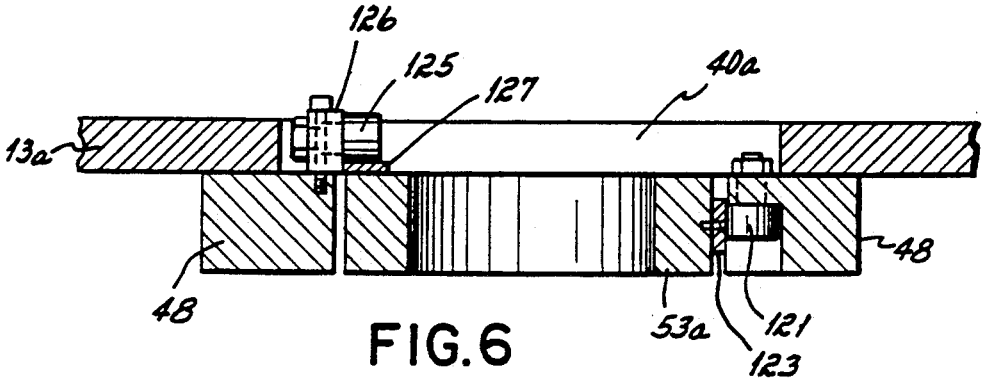
FIG. 6 is a cross-sectional view along line 6—6 of FIG. 3.

FIGS. 3, 5 and 6 show in greater detail the slidable mounting between the guides or slides 53*a* and 53*b* and the housings 13*a* and 13*b*. More particularly, with respect to the front slide 53*a* as shown in FIGS. 3 and 6, the slide 53*a* is provided with a pair of rollers 121 rotatably mounted to the insert housing or collar 48 so as to rollably contact a pair of plates 123 mounted to the side of the slide 53*a*. The length of the plates 123 need only be short in that the motion of the slide 53 is very small and need only be sufficient to move the upper shaft 42 enough to provide clearance for the paper web 24 while it was being inserted between the roller assemblies 21 and 22. Similarly, a roller 125 is rotatably attached on a bracket 126 to the collar 48 and disposed perpendicular to the shaft 42 so as to ride on a plate 127 secured to the back of the front slide 53*a* as shown in FIG. 6. Similarly, rollers 128 and 129 and 130 are provided at the rear housing 13*b* to guide and slidably support the rear slide 53*b* in the housing 13*b*.

In operation, once the web 24 is inserted between the cylinders 77 and 78, the tilt of the shafts 41 and 42 is adjusted, and the operating printing pressure is set by setting the knobs 107 and 108 to position the wedge pairs 93 and 94. Then, the hydraulic rams 81, 82 when activated drive the guides or slides 53*a*, 53*b* against the stop positions between the cam blocks 99 and 100 and the wedges 93 and 94, respectively. This presses the cylinder assemblies 21 and 22 together, causing them to self adjust about the bearings 73 and 74 to balance the printing pressure across the width of the web 24.

Having described the invention, what is claimed is the following:

1. An intaglio printing press comprising:

frame means;

two slide members slidably mounted upon said frame means;

first and second shafts mounted on said frame means in approximately parallel spaced relationship with each other, each of said shafts having a cantilevered free end projecting from the same side of said frame means, said first shaft being fixedly mounted to said frame means and said second shaft being mounted to each of said slide members;

a pair of rollers, including a print roller and an impression roller, each being rotatably mounted to the free end of a different one of said shafts and each positioned to make rolling contact with a web of printing substrate moving therebetween; and means for shifting said slide members relative to said frame means for deflecting said second shaft toward said first shaft to drive said rollers together to exert printing pressure upon said web.

2. The intaglio press of claim 1 wherein said slide member shifting means includes a pair of hydraulic rams mounted upon said frame means each connected between said frame means and a different one of said slide members.

3. The intaglio press of claim 1 further comprising:

mounting means, including a pair of spherical bearings, one mounted around each of said cantilevered free ends of said shafts within the roller mounted thereon, for supporting said rollers on said shafts so as to allow said rollers to rotate thereon and to tilt thereon to allow the angle between the axis of the roller and of the shaft to vary and thereby to maintain a parallel relationship of one roller with the other at the printing nip.

4. The intaglio press of claim 1 further comprising:

a pair of adjustable wedges mounted on said frame means between the slide and said frame means, each of said wedges being movable in a direction transverse the direction of movement of the slide members and operable to regulate the spacing of each slide member with respect to the frame means on which it is mounted, and thereby the deflection of said second shaft with respect to said first shaft, to regulate the amount of printing squeeze on the paper web.

5. An intaglio printing press comprising:

a frame including a pair of stationary frame members, each having a slide member slidably mounted thereon;

a pair of cylinder support shafts mounted on said frame in approximately parallel spaced relationship with each other, each extending between said frame members and having a cantilevered free end projecting from said frame, one of said pair of shafts being rigidly mounted to each of said frame members, the other of said shafts being rigidly mounted to each of said slide members;

a pair of rollers, including a print roller and an impression roller, each being rotatably mounted to the free end of a different one of said shafts and each positioned to make rolling contact with a web of printing substrate moving therebetween;

means in engagement with said slide members for urging said shafts toward each other thereby causing said rollers to apply printing pressure to said web; and mounting means for each of said rollers, said mounting means including spherical bearings mounted around one of said cantilevered free ends of said shafts within the roller mounted thereon, for supporting said rollers on said shafts so as to allow said rollers to rotate thereon and to tilt thereon to allow the angle between the axis of the roller and of the shaft to vary.

6. An intaglio printing press comprising:

a frame including a pair of stationary frame members, each having a slide member slidably mounted thereon;

a pair of cylinder support shafts mounted on said frame in approximately parallel spaced relationship with each other, each extending between said frame members and having a cantilevered free end projecting from said frame, said pair of shafts including a fixed shaft rigidly mounted to each of said frame members and a movable shaft rigidly mounted to each of said slide members;

a pair of rollers, including a print roller and an impression roller, each being rotatably mounted to the free end of a different one of said shafts and each positioned to make rolling contact with each other and with a web of printing substrate moving therebetween;

means connected between said slide members and said frame for urging said shafts toward each other thereby pressing said rollers together to apply printing pressure to said web; and a pair of adjustable wedges, one mounted on each of said frame members between the slide and the frame, and each movable thereon in a direction transverse the direction of movement of the slide members on the frame, and operable to regulate the spacing of each slide member with respect to the frame member on which it is mounted and thereby the deflection of one shaft with respect to the other at the respective members, so as to control the tilting of one shaft with respect to the other and thereby limit the printing pressure exerted upon said web by said rollers.

7. An intaglio printing press comprising:

a stationary frame;

a pair of shafts mounted in approximately parallel spaced relationship to each other on said frame, each of said shafts having a cantilevered free end projecting from said frame;

a pair of rollers, including a print roller and an impression roller, each being rotatably mounted to the free end of a different one of said shafts and each positioned to make rolling contact with a printing substrate moving therebetween; and means on said frame for shifting at least one of said shafts with respect to said frame so as to urge the free cantilevered ends of said shafts and the roller mounted thereon toward the other of said rollers to thereby exert high printing pressure on the substrate between said rollers.

8. The intaglio press of claim 7 wherein each of said shafts and each of said rollers has an axis, and said press further comprises:

bearing means, carried on the free cantilevered ends of each of said shafts and rotatably supporting said rollers near their centers on said cantilevered ends, said bearing means permitting the axes of said rollers to freely tilt toward parallel relationship with each other in response to the distribution of printing pressure across the width of said rollers and said substrate.

9. The intaglio press of claim 8 wherein said bearing means include a pair of spherical bearings, one mounted around each of said cantilevered free ends of said shafts within the rollers mounted thereon, and each operable to support the roller and allow the roller to rotate about the axis of the shaft and to allow the angle between the axis of the roller and of the shaft to change in response to unbalanced pressure distribution between said rollers across the width of the substrate.

10. The intaglio press of claim 7 further comprising adjustable stop means for limiting the deflection of one of said shafts and to thereby control the orientation of the shafts with respect to each other.

11. The intaglio press of claim 10 wherein each of said shafts is interengaged with said frame at at least two spaced points along said shafts, one of said shafts being deflectably mounted with respect to said frame at at least one of said points, said press further comprising a movable mechanical stop for limiting the deflection.

12. The intaglio press of claim 10 wherein at least one of said shafts is movably mounted to said frame so as to move toward and away from the other of said shafts, said press further comprising a movable wedge positionable between the movable shaft and said frame to limit the relative movement of the shafts to thereby limit the force exerted between said rollers and upon said substrate.

13. The intaglio press of claim 9 wherein each of said shafts is supported at at least two spaced points along said shafts, one of said shafts being movably mounted to said frame at at least one of said points so as to move toward and away from the other of said shafts, said press further comprising a movable wedge positionable between the movable shaft and said frame to control the tilt of the movable shaft with respect the other to regulate the printing pressure exerted on the substrate by said rollers.

14. In a method of intaglio printing, the steps of:

supporting a pair of shafts cantilevered from a stationary frame whereby each of said shafts has a free end in approximately parallel spaced relationship to each other;

supporting a print roller and an impression roller, each to the free end of a different one of said shafts and positioned to make rolling contact across their widths with a substrate web moving therebetween; and applying a force to one of said shafts remote from the free end to angularly displace said shaft with respect to the other of said shafts and to urge its free end toward the free end of the other of said shafts to force said rollers together against said web to exert high printing pressure therebetween.

15. In a method of intaglio printing, the steps of:

supporting a pair of shafts cantilevered from a stationary frame whereby each of said shafts has a free end in approximately parallel spaced relationship to each other;

supporting a print roller and an impression roller, each to the free end of a different one of said shafts and positioned to make rolling contact across their widths with a substrate web moving therebetween;

applying a force to one of said shafts to urge its free end toward the free end of the other of said shafts to force said rollers together against said web to exert high printing pressure therebetween; and said rollers being supported near their centers on said cantilevered ends, and freely tilt toward parallel relationship with each other in response to the distribution of printing pressure across the width of said rollers and said substrate.

* * * * *

UNITED STATES PATENT AND TRADEMARK OFFICE

CERTIFICATE OF CORRECTION

PATENT NO. : 4,991,503

DATED : February 12, 1991

INVENTOR(S) : Robert W. Morner

It is certified that error appears in the above-identified patent and that said Letters Patent is hereby corrected as shown below:

Column 2, line 17, after shaft delete "provides for easier means interchanging" and insert -- provide for easier interchanging --

Column 4, line 35, delete "nonparrellelism" and insert -- non-parallelism --

Column 6, line 30, "verticallY" should be -- vertically --

Signed and Sealed this

Ninth Day of February, 1993

*Attest:*

STEPHEN G. KUNIN

*Attesting Officer*

*Acting Commissioner of Patents and Trademarks*